US005932089A

United States Patent [19]

Moore

[11] Patent Number: 5,932,089

[45] Date of Patent: Aug. 3, 1999

[54] PETROLEUM COKER COOLING METHOD WITH MINIMUM COKE DRUM STRESS

[75] Inventor: David E. Moore, Yorba Linda, Calif.

[73] Assignee: Atlantic Richfield Company, Los Angeles, Calif.

[21] Appl. No.: 08/939,184

[22] Filed: Sep. 29, 1997

Related U.S. Application Data

[63] Continuation of application No. 08/794,199, Jan. 24, 1997, abandoned.

[51] Int. Cl.[6] ..... C10G 9/12

[52] U.S. Cl. ..... 208/48 Q; 208/48 R; 208/50; 208/131; 585/240; 201/39

[58] Field of Search ..... 208/48 R, 131, 208/48 Q; 134/167 R; 202/241; 196/126; 585/240

[56] References Cited

U.S. PATENT DOCUMENTS

| | | | |
|---|---|---|---|
| 3,557,241 | 1/1971 | Kivlen et al. | 260/683 |
| 3,592,762 | 7/1971 | Blaser et al. | 208/48 |
| 3,641,190 | 2/1972 | Kivlen et al. | 208/48 |
| 3,812,028 | 5/1974 | Snyder | 208/113 |
| 3,818,975 | 6/1974 | Tokumitsu et al. | 208/48 R |
| 3,920,537 | 11/1975 | Walker | 208/48 |
| 4,013,518 | 3/1977 | Miko | 202/241 |
| 4,196,050 | 4/1980 | Takahashi | 196/122 |
| 4,224,108 | 9/1980 | Takahashi | 196/122 |

OTHER PUBLICATIONS

"Experience With Vessels of Delayed–Coking Units" by N.A. Weil and F.S. Rapasky, presented at the 23rd Midyear Meeting of the American Petroleum Institute's Division of Refining, Los Angeles, California, May 13, 1958, vol. 38 (III), pp. 214–232.

*Primary Examiner*—Helane Myers
*Attorney, Agent, or Firm*—F. Lindsey Scott

[57] ABSTRACT

A method is provided for cooling prior to decoking a petroleum coke drum having a substantially solidified mass of petroleum coke by initiating the injection of water into the coke drum while the average temperature of the coke within the coke drum is greater than about 500° F., wherein the average flow rate of water injected into the coke drum over the initial 10 minute period of water injection is from about 0.0033 to about 0.01 gpm per cubic foot of coke in the coke drum; and thereafter continuing the injection of water into the drum for a total injection time of at least about 60 minutes, at a flow rate during the 50 minute period immediately following the initial 10 minute period less than about 0.0036 to about 0.011 gpm per cubic foot of coke in the coke drum.

7 Claims, No Drawings

PETROLEUM COKER COOLING METHOD WITH MINIMUM COKE DRUM STRESS

CROSS-REFERENCE TO RELATED APPLICATION

This is a continuation of application Ser. No. 08/794,199, filed Jan. 24, 1997 now abandoned.

FIELD OF THE INVENTION

This invention relates generally to methods for cooling petroleum coke in petroleum coke drums and, particularly, to methods for cooling petroleum coke in petroleum coke drums using injected water.

BACKGROUND

The production of petroleum coke from the residuum portion of petroleum crude oil is a common operation in most crude oil refineries. The manufacture of petroleum coke is generally accomplished by placing heated residuum into large vertical vessels termed "coke drums," and allowing the residuum to stand (in the absence of air) for several hours. The residuum slowly solidifies into a mostly carbonatious solid material. In the process, additional hydrocarbonatious materials are driven off and recovered. At the end of the cycle, the coke drum is filled with a generally solid, albeit porous, mass of petroleum coke.

After solidification, the coke must be removed from the coke drum. This is generally accomplished by injecting water into the bottom of the coke drum while the coke is still hot. Much of the water flashes to steam which rises upwardly through the porous mass of coke.

In the present-day method of injecting water into the coke drum, a very high rate of water is initially injected. This is commonly called "proofing." Almost immediately thereafter, the injection rate is reduced to a smaller flow rate, but then the flow rate is steadily increased ("ramped up") from this smaller flow rate throughout the initial first hour of water injection.

It has been found, however, that present-day methods of injecting water into the hot coke severely stresses the steel shell of the coke drum. Such stressing causes metal fatigue and eventual failure of the coke drum.

Accordingly, there is a need for a method for cooling petroleum coke in a petroleum coke drum which is less stressful to the coke drum than are prior art methods.

SUMMARY

The invention satisfies this need. The invention is a method for removing coke from a coke drum which contains a substantially solidified mass of coke. The method comprises the steps of: (a) initiating the injection of water into the coke drum while the average temperature of the coke within the coke drum is greater than about 500° F., wherein the average flow rate of water injected into the coke drum over the initial 10 minute period of water injection is X; and (b) thereafter continuing the injection of water into the drum for a total injection time of at least about 60 minutes, such that the average flow rate during the 50 minute period of water injection immediately following the initial 10 minute period of water injection is Y, wherein Y is less than about X+0.1X.

By this method, the solid mass of coke within the coke drum is broken up by the injection of water at a substantially constant rate, i.e., substantially no "ramp-up."

In a typical embodiment, the average water injection rate during each continuous 5-minute portions of the initial total 60 minutes of water injection is less than about X+0.3X, preferably less than about X+0.1X.

Thus, it is preferred in the invention that the injection of water into the coke drum be substantially constant throughout the first 60 minutes of injection, i.e., substantially no "proofing."

Preferably, the rate of water injection X is as low as possible, such as between about 0.005 V and about 0.007 V, where V is the volume of coke within the coke drum expressed in units of cubic feet and X is expressed in units of gallons per minute.

The method has been found to provide an efficient way of removing petroleum coke from a petroleum coke drum with minimum stress to the coke drum.

These and other features, aspects and advantages of the present invention will become better understood with reference to the following description and appended claims.

DETAILED DESCRIPTION OF THE INVENTION

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

The invention is a method for cooling petroleum coke in a petroleum coke drum wherein the coke drum contains a substantially solidified mass of petroleum coke. The method comprises the steps of (a) initiating the injection of water into the coke drum while the average temperature of the coke within the coke drum is greater than about 500° F., wherein the average flow rate of water injected into the coke drum over the initial 10 minute period of water injection is X; and (b) thereafter continuing the injection of water into the drum for a total injection time of at least about 60 minutes, such that the average flow rate. during the 50 minute period of water injection immediately following the initial 10 minute period of water injection is Y, wherein Y is less than about X+0.1X.

Typically, the temperature of the coke at the time of initiating the injection of water into the drum is between about 675° F. and about 875° F., preferably between about 700° F. and about 850° F., most preferably between about 700° F. and about 750° F.

Also, it is preferable that Y be less than X+0.05X, most preferably less than X+0.02X. Also, it is preferable that the average water injection rate during each and every continuous 5-minute portion of the total 60 minutes of water injection is less than about X+0.3X, preferably less than about X+0.1X.

Preferably, the rate of water injection X is as low as possible, such as between about 0.005 V and about 0.007 V, where V is the volume of coke within the coke drum expressed in units of cubic feet and X is expressed in units of gallons per minute.

In a typical decoking operation wherein the coke drum has a diameter of about 25 feet and the volume of coke is about 30,000 cu. ft., X is typically between about 100 gpm and about 300 gpm, preferably between about 140 gpm and about 210 gpm.

The invention is contrasted with the present-day practice of "proofing" the hot coke mass with an initial injection of water at a very high rate, followed by an almost immediate reduction of the rate of injected water to a somewhat lower rate, but thereafter "ramping up" the rate of water injection by steadily increasing the rate of water injection over the remainder of the first 60 minutes of water injection. It has been found that both "proofing" and "ramping up" practices at high proofing and/or ramping up rates cause undue stress to the walls of the coke drum.

EXAMPLE

Comparison tests were conducted on an operating 26 foot diameter coke drum during actual decoking cycles. The coke drum was of steel construction (SA 204 Grade C clad with SA 263-type 410S), having upright cylindrical sides, a domed head and a frustroconical bottom. The lower portions of the coker had walls one-inch thick, the upper portions had walls three quarter-inch thick.

A plurality of strain gauges was attached to the coker drum. Each of the strain gauges was oriented in the vertical direction because it is known that strain within an operating coke drum is generally greatest in the vertical direction. Strain in the test coke drum was then measured in the drum during repeated normal coking operation cycles under two sets of decoking operating parameters. These two sets of decoking operating parameters are set forth in Table 1 below.

TABLE 1

| | Test Conditions #1 | Test Conditions #2 |
|---|---|---|
| Coke Volume | 29,300 cu. ft. | 29,300 cu. ft. |
| Average Temp. of Coke at Time of Initial Water Injection | 750° F. | 750° F. |
| Approximate Proofing Flow Rate | 630 gpm | 280 gpm |
| Proofing Duration | 5 min. | 5 min. |
| Initial Flow Rate After Proofing | 315 gpm | 175 gpm |
| Ramp Up Rate | 3 gpm/min. | 0 gpm/min. |
| Total Length of Water Injection | 60 min. | 60 min. |
| Mean Observed Drum Strain Range | 940 | 780 |
| Maximum Observed Drum Strain Range | 3290 | 1700 |

During the initial 60 minutes of decoking water injection, strain in the drum was measured at 30-second intervals. The strain data was then compiled for each of the two operating conditions, where the strain range $\Delta E_i = \max E_i - \min E_i$, where $E_i$ is the strain measured at each strain gauge, and is measured against the frequency of each such reported strain range.

The decoking procedure using lower proofing flow rates, lower ramping rates and lower average water injection flow rates resulted in considerably less strain. For example, the mean $\Delta E$ was reduced by 18% and the maximum $\Delta E$ was reduced by 51%. If a yield strength of 35 ksi is assumed for the shell material, this reduction in stress corresponds to a stress range of 70 ksi or a strain range of 2330 (assuming that the mean stress in a cycle is equal to zero).

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A method for cooling a substantially solidified mass of coke in a coke drum, the method comprising the steps of:

(a) initiating the injection of water into the coke drum while the average temperature of the coke within the coke drum is greater than about 500° F. and less than about 850° F. wherein the average flow rate of water injected into the coke drum over the initial 10 minute period of water injection is from about 0.0033 to about 0.01 gpm per cubic foot of coke in the coke drum; and (b) thereafter continuing the injection of water into the drum for a total injection time of at least about 60 minutes, such that the average flow rate of water during the 50 minute period of water injection immediately following the initial 10 minute period of water injection is, less than about 0.0036 to about 0.011 gpm per cubic foot of coke in the coke drum.

2. The method of claim 1 wherein the average water injection flow rate during the initial 10 minute period of water injection is between about 0.0047 and about 0.007 gpm per cubic foot of coke in the coke drum.

3. The method of claim 1 wherein the initiating of water injection into the drum in step (a) is initiated when the average temperature of the coke within the drum is between about 675° F. and about 875° F.

4. The method of claim 1 wherein the initiating of water injection into the drum in step (a) is initiated when the average temperature of the coke within the drum is between about 700° F. and about 850° F.

5. The method of claim 1 wherein the initiating of water injection into the drum in step (a) is initiated when the average temperature of the coke within the drum is between about 700° F. and about 750° F.

6. The method of claim 1 wherein the average water injection flow rate during the initial 10 minute period of water injection, X, is between about 0.005 V and about 0.007 V, where V is the volume of coke within the coke drum expressed in units of cubic feet and X is expressed in units of gallons of water per minute.

7. A method for cooling coke in a coke drum which contains a substantially solidified mass of coke at an average coke temperature of between about 700° F. and about 850° F., the method comprising the step of continuously injecting water into the coke drum for a period of at least about 60 minutes at an average flow rate from about 0.0033 to about 0.01 gpm per cubic foot of the coke in the coke drum.

* * * * *